US006814807B1

(12) United States Patent
Carr et al.

(10) Patent No.: US 6,814,807 B1
(45) Date of Patent: Nov. 9, 2004

(54) APPARATUS FOR SINGLE-END SLASHING

(75) Inventors: Wallace W. Carr, Atlanta, GA (US); Hyunyoung Ok, Atlanta, GA (US); Joseph D. Brooks, Stockbridge, GA (US); Heungsup Park, Atlanta, GA (US)

(73) Assignee: Georgia Tech Research Corp., Atlanta, GA (US)

( * ) Notice: Subject to any disclaimer, the term of this patent is extended or adjusted under 35 U.S.C. 154(b) by 0 days.

(21) Appl. No.: 10/246,987

(22) Filed: Sep. 19, 2002

Related U.S. Application Data

(60) Provisional application No. 60/323,283, filed on Sep. 19, 2001.

(51) Int. Cl.[7] ..... B05C 3/12

(52) U.S. Cl. ..... 118/420; 118/78; 118/405; 118/423; 427/11; 427/170; 427/434.7

(58) Field of Search ..... 118/78, 109, 405, 118/420, 423; 427/11, 170, 434.7

(56) References Cited

U.S. PATENT DOCUMENTS

| | | | | |
|---|---|---|---|---|
| 3,893,412 A | * | 7/1975 | Louch et al. | 118/420 |
| 3,924,028 A | * | 12/1975 | Benson et al. | 427/175 |
| 4,059,068 A | | 11/1977 | Guillermin et al. | |
| 4,095,558 A | * | 6/1978 | Ellegast et al. | 118/420 |
| 4,329,750 A | * | 5/1982 | Binnersley | 8/151.2 |
| 4,389,966 A | * | 6/1983 | Getz | 118/405 |
| 5,181,401 A | | 1/1993 | Hodan | |
| 5,501,734 A | | 3/1996 | Oliphant | |
| 5,626,676 A | | 5/1997 | Voswinckel | |
| 5,683,511 A | | 11/1997 | Kremers et al. | |
| 5,709,910 A | | 1/1998 | Argyle et al. | |
| 6,067,928 A | * | 5/2000 | Holzer et al. | 118/33 |
| 6,258,406 B1 | | 7/2001 | Enders et al. | |
| 6,543,580 B1 | * | 4/2003 | Gathmann et al. | 118/33 |
| 2002/0104204 A1 | | 8/2002 | Nakade | |

* cited by examiner

*Primary Examiner*—Chris Fiorilla
*Assistant Examiner*—Michelle Acevedo Lazor
(74) *Attorney, Agent, or Firm*—Todd Deveau; Thomas, Kayden, Horstemeyer & Risley LLP

(57) ABSTRACT

An apparatus for applying metered fluid such as sizing to an advancing individual yarn in a uniform manner. An elongated member includes at least one slot for receiving the advancing yarn and to bring the advancing yarn into contact with the metered fluid. The slot is defined by a width, a height and a length for affecting the distribution of the fluid on the advancing yarn. The length of the slot is dependent on the speed of the advancing yarn. The advancing yarn has a predetermined residence time in the slot as a function of the length of the slot and the speeding of the advancing yarn in the slot.

20 Claims, 5 Drawing Sheets

APPARATUS FOR SINGLE-END SLASHING

RELATED APPLICATION

This application claims the benefit of U.S. Provisional Application having Ser. No. 60/323,283, entitled "Apparatus for Single-End Slashing" and filed Sep. 19, 2001.

TECHNICAL FIELD

The present invention relates to the manufacture of yarn and, more particularly, relates to the coating or dyeing of yarn traveling at high speed.

BACKGROUND OF THE INVENTION

The process of weaving yarn into fabrics often damages the yarns. To prevent damage, a protective coating is typically applied to the surface of the yarn prior to weaving. This protective coating is typically applied as a liquid solution called size or sizing. The application of size is commonly referred to as slashing. However, the application of sizing is time consuming which results in significant delays in the manufacture of yarns suitable for weaving.

In known methods of applying sizing, a sheet of closely spaced yarns are slashed by passing the sheet of yarns through an aqueous solution of sizing. Typically, the sheet of yarn has a residence time of 0.25 seconds, or greater, in the solution. The sheet of yarns is then squeezed by high pressure rollers that drive the sizing into the sheet of yarns. However, the sizing is often not distributed uniformly over each yarn.

Next, the sheet of yarns is dried by passing it over a heated drum which produces a solid sheet of yarns held together by the dried sizing. The yarns of the sheet are then separated by passing them over and under lease rods. Separating the yarns in this manner, however, causes damage to the yarns. Fibers are often broken and left protruding from the surface of the yarn as a result of this separation process. This creates a hairy yarn which is undesirable. If the yarns did not need to be separated after sizing, this damage would not occur.

There are techniques known for applying treatments such as chemical coatings or dyes to individual yarns. These known techniques apply the treatments by passing each yarn, traveling at low speed, through an opening such as an eyelet or slot having sides configured for applying the treatment and to prevent the yarn from jumping out. Typically, the process of making rows of yarn, referred to as beams, run at speeds as high as approximately 1,000 yards per minute. With traditional methods of slashing individual yarns or sheets of yarn, however, the run speed has to be reduced to below 100 yards per minute. Moreover, the sizing is applied intermittently to the individual yarns and, therefore, is not applied in a uniform manner.

Also, these known techniques attempt to achieve uniform application by the manner in which the treatment is introduced to the yarn. None of these known techniques facilitate the application of the treatment in a substantially uniform manner to yarn advancing at speeds above 100 yards per minute.

Therefore, there is a need for a new slashing method to optimize the application of sizing when the yarns are advanced at high speed. This new slashing method applies sizing to each yarn separately in a metered fashion for uniform application eliminating the separation process described above. The yarn is sized in a fast and cost effective manner without the resulting yarns having a hairy surface.

SUMMARY OF THE INVENTION

The present invention solves the above-identified problem by providing an improved apparatus for single-end slashing.

This improved apparatus includes an optimally configured slot to facilitate the uniform application of sizing to individual yarns advancing at high speed.

Generally described, the present invention includes a slot applicator having at least one slot for receiving an individual yarn. Fluid is metered into the slot as the yarn advances through the slot. The slot has an extended length dimensioned for affecting the distribution of the fluid on the advancing yarn. In particular, the length of the slot is dependent on the speed of the advancing yarn. The length creates additional contact between the advancing yarn and the metered fluid.

According to one aspect of the present invention, the advancing yarn has a predetermined residence time in the slot. The required residence time is a function of yarn construction, fiber type, fluid properties and yarn speed.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
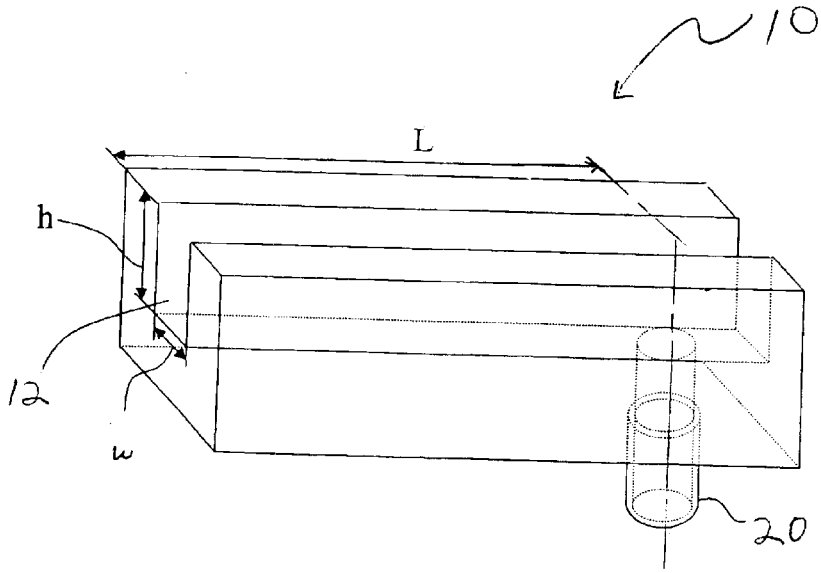
FIG. 1 illustrates a perspective view of one embodiment of the slot applicator of the present invention defined by a length L, height h and width w.
Figure 2:
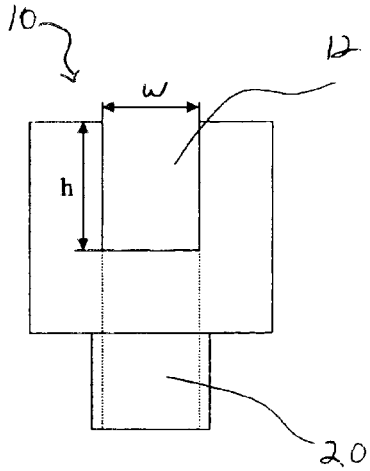
FIG. 2 illustrates an end view of the slot applicator depicted in FIG. 1.
Figure 3:
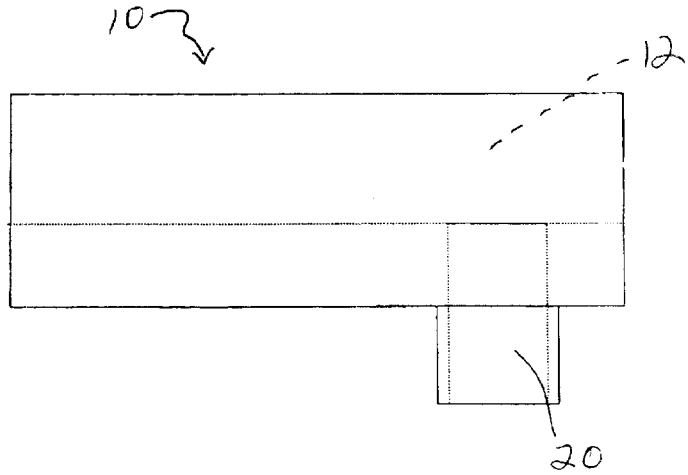
FIG. 3 illustrates a front view of the slot applicator of FIG. 1.

Referring now to the drawings in which like numerals indicate like elements throughout the several views, FIGS. 1-3 depict an elongated member 10, referred to as slot applicator 10, having a slot 12 for receiving advancing yarn and to bring the advancing yarn into contact with a fluid being metered into the slot 12. The applicator 10 is preferably made of aluminum, Delrin®, or stainless steel. The slot 12 is configured to receive an individual thread line of yarn.

However, multiple slots can be used to size multiple individual yarns simultaneously.

As explained above, known slasher processes operate at reduced speeds of less then approximately 100 yards per minute which results in a significant delay in the process of weaving yarn. However, the slot 12 of the present invention is configured to permit uniform application of the metered fluid to the yarn advancing at speeds below 100 yards per minute as well as speeds up to and greater than 1,000 yards per minute. Commercial machines, called warpers, wind up sheets of yarn at speeds up to about 1,000 yards per minute. Thus, the slot applicator 10 could be operated at speeds up to 1,000 yards per minute with warpers winding up the sized yarn. Therefore, the process of weaving yarn from slashed yarn can be accelerated because the delay due to application of sizing has been eliminated.

As best shown in FIG. 1, the slot 12 of the planar applicator 10 has a width w, a height h and a length L for affecting the distribution of fluid on the advancing yarn. The fluid, for example, can be either a sizing solution or a dye solution. Preferably, the height h is preferably approximately ¼ inches. Otherwise, the height h of the slot 12 must be sufficient to prevent loss of the fluid from the open side of the slot 12. The width w should be sufficiently large so as to not pinch the yarn and cause abrasion, but small enough so that the fluid is substantially continuously in contact with the advancing yarn to provide uniform coverage. More particularly, the width w is determined from a ratio of the slot width w to yarn diameter. Preferably, the ratio of slot width w to yarn diameter ranges from 1.1 to 10. However, the optimum ratio ranges from 1.2 to 5.0.

The length L of the slot 12 of the present invention depends on the speed of the advancing yarn, yarn construction, fiber type, and fluid properties such as viscosity and surface tension. As the speed of the advancing yarn increases and/or viscosity of the fluid increases, longer slots are needed. If the length of slot 12 is too short, fluid coverage on the advancing yarn is diminished and sizing may flow from the exit of slot 12 without covering the surface of the advancing yarn.

Preferably, the length L of the slot 12 is long enough to provide at least a 0.03 second residence time of the advancing yarn in the slot 12. Preferably, at ambient temperature, a longer residence time of 0.08 seconds is recommended when a sizing solution having a viscosity of approximately 25 centipoise (cP) is utilized to size yarn of 10's cotton count (10 hanks in each pound of yarn) at a process speed of approximately 500 yards per minute. In this example, using the formula x=vt, wherein x is the length L, v is the speed of the advancing yarn, in this case 500 yards per minute, and t is the residence time of 0.08 seconds, the slot 12 should have a length L of at least approximately 24 inches in order to provide the 0.08 second residence time.

The approximate coverage of sizing as a result of utilizing a slot 12 with varying dimensions is shown in the Table below. For the examples in the Table below, with yarn advancing at between 100 to 500 yards per minute, the preferred length L of the slot 12 is about 24 inches which results in coverage of approximately 90–95%. However, slower rates of advancing yarn result in longer residence times.

| Slot dimensions | | | |
|---|---|---|---|
| Height (inch) | Length (inch) | Width (inch) | Approx. Coverage (%) |
| 0.25 | 9 | 0.031 | 75 |
| | | 0.047 | 70 |
| | | 0.063 | 70 |
| | 12 | 0.031 | 75 |
| | | 0.047 | 70 |
| | | 0.063 | 65 |
| | 18 | 0.031 | 95 |
| | | 0.047 | 80 |
| | | 0.063 | 70 |
| | 24 | 0.020 | 95 |
| | | 0.031 | 95 |
| | | 0.047 | 90 |
| | | 0.063 | 95 |

However, the length L of the slot 12 is variable. For example, with a sizing solution having a viscosity of approximately 23 cP and cotton yarn having a cotton count of 10's, the slot 12 can preferably have a length as small as approximately 2 inches. In such case, however, the yarn may only be advanced at a speed of approximately 10 to 20 yards per minute to obtain coverage of 90–95%. Moreover, if different yarn and size solution is used, the preferred speed of the advancing yarn would be different. Also, as viscosity is reduced, the length L of the slot 12 can be reduced.

For highly viscous fluids, on the other hand, the slot 12 can have a length L as large as approximately 48 inches. A longer slot is required when advancing the yarn at speeds approaching the speed at which warpers operate commercially. For example, with a sizing solution having a viscosity of approximately 25 cP and the cotton yarn having a cotton count of 10's, the slot 12 can preferably have a length of approximately 48 inches while advancing the yarn at a speed of approximately 800 yards per minute. However, if different yarn and size solution is used, the speed of the advancing yarn would be different.

The fluid is metered into the bottom of the slot 12, along the length L, through a passageway 20 from a continuous supply of fluid. As best shown in FIG. 1, the beginning of the length L of the slot 12 is determined from the junction of the passageway 20 and slot 12. The length L then extends to the opposite, end of the slot 12 where the advancing yarn exits the slot applicator 10. Several fluids can be metered into a single slot 12 as described in greater detail below. The fluid may be solutions, sizing, dye, finishes, prewetting water/solutions, or chemical treatments.

Figure 4:
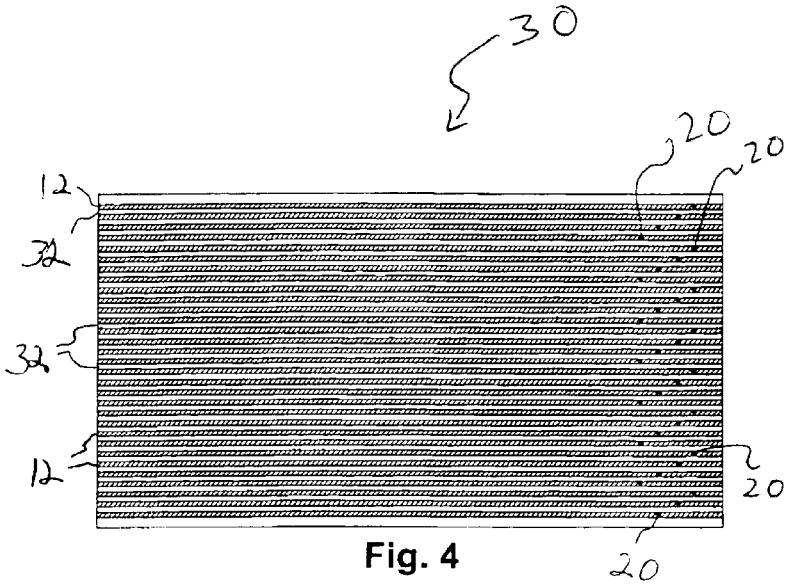
FIG. 4 illustrates a top view of one embodiment of an applicator having a bank of slots of FIG. 1.
Figure 5:
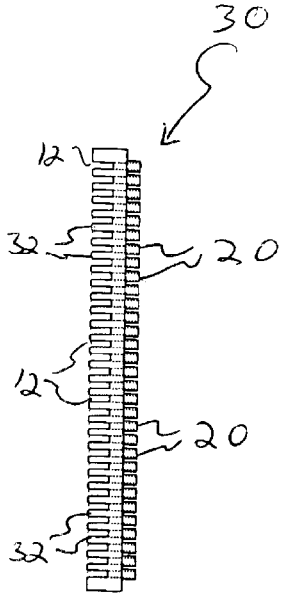
FIG. 5 is an end view of the slot applicator of FIG. 4.
Figure 6:
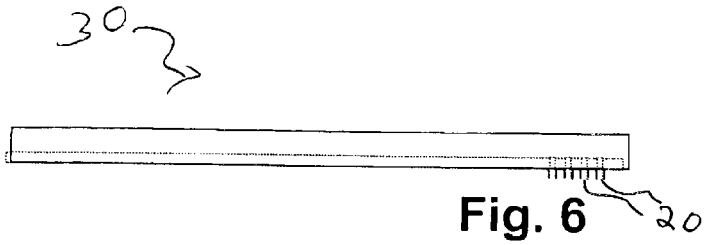
FIG. 6 illustrates a front view of the slot applicator of FIG. 4.

FIGS. 4 and 5 illustrate a slot applicator 30 which is a bank of slots 12 for applying fluid to a sheet of individual yarns. Each slot 12 of the slot applicator 30 corresponds to an individual thread line of yarn and is separated by a divider 32 of the slot applicator 30. The bottom of each slot 12 includes a passageway 20 for providing the metered fluid. As best shown in FIG. 4, the passages 20 of adjacent slots 12 are offset from one another along the length L. Preferably, every fourth passageway corresponds with each other.

Figure 7:
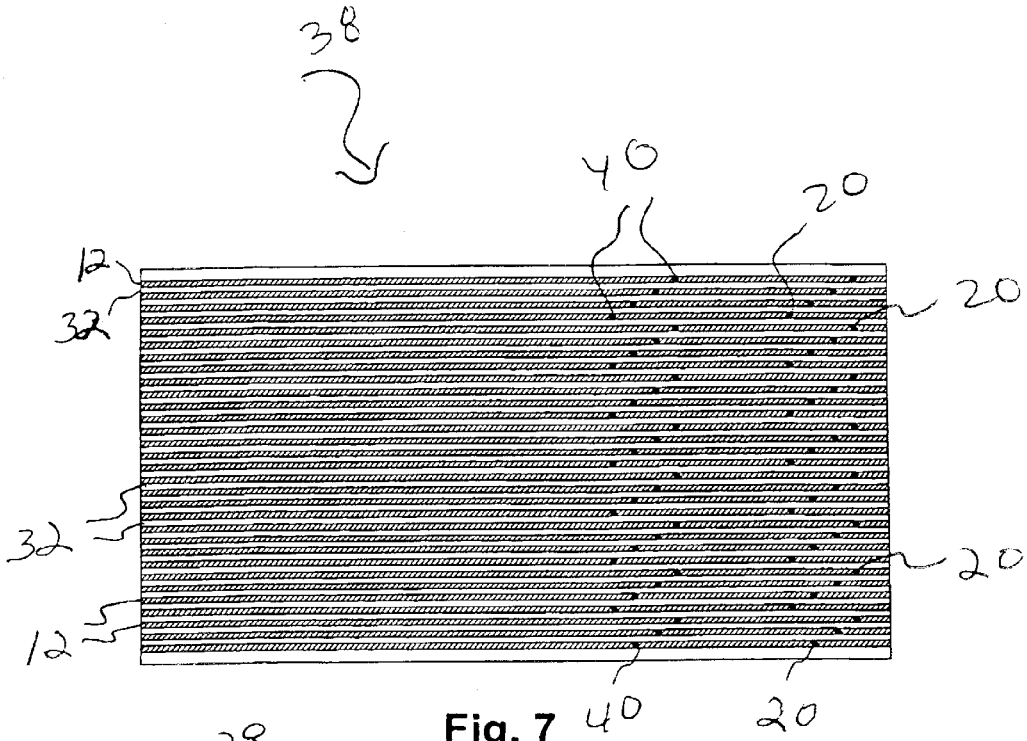
FIG. 7 illustrates an alternative embodiment of a slot applicator of FIG. 4 wherein each slot includes a pair of inlets for passing fluids into the slot.
Figure 8:
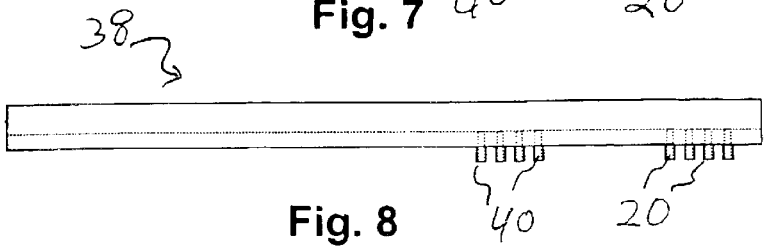
FIG. 8 illustrates a front view of the slot applicator of FIG. 7.

In an alternative embodiment, as shown in FIGS. 7 and 8, a slot applicator 38 which also includes a bank of slots 12, includes a plurality of passageways 40 in addition to passageways 20. The slot applicator 38 is identical to slot applicator 30 except for the addition of passageways 40. Each slot 12 of the slot applicator 38 corresponds to an individual thread line of yarn, but two different fluids may be metered into each slot 12 via passageways 20 and 40, respectively.

For example, prewetting the yarn allows sizing to be picked up much easier and provides better sizing coverage. The prewetting solution wets the yarn surface much faster than the size solution, and the size solution will flow much faster over the wetted yarn surface. The prewetting solution typically includes water and surfactant. Providing the prewetting solution through the passageways 20 and the sizing through passageways 40 significantly improves yarn coverage by the size solution. When utilizing the prewetting solution from passageways 20 and sizing through passageways 40, the beginning of the length L is determined from each of the passageways 40 because the passageways 40 are where the fluid, requiring uniform distribution, is metered into the slot 12. The distance between the openings of passageway 20 and the passageway 40 along the length L of a particular slot 12 can be varied to facilitate the uniform application of fluid on the thread line. Although the Figures of the present invention depict only the passageways 20 and 40, the slot applicators of the present invention can include any number of passageways for metering in a corresponding number of different desired fluids.

Figure 9:
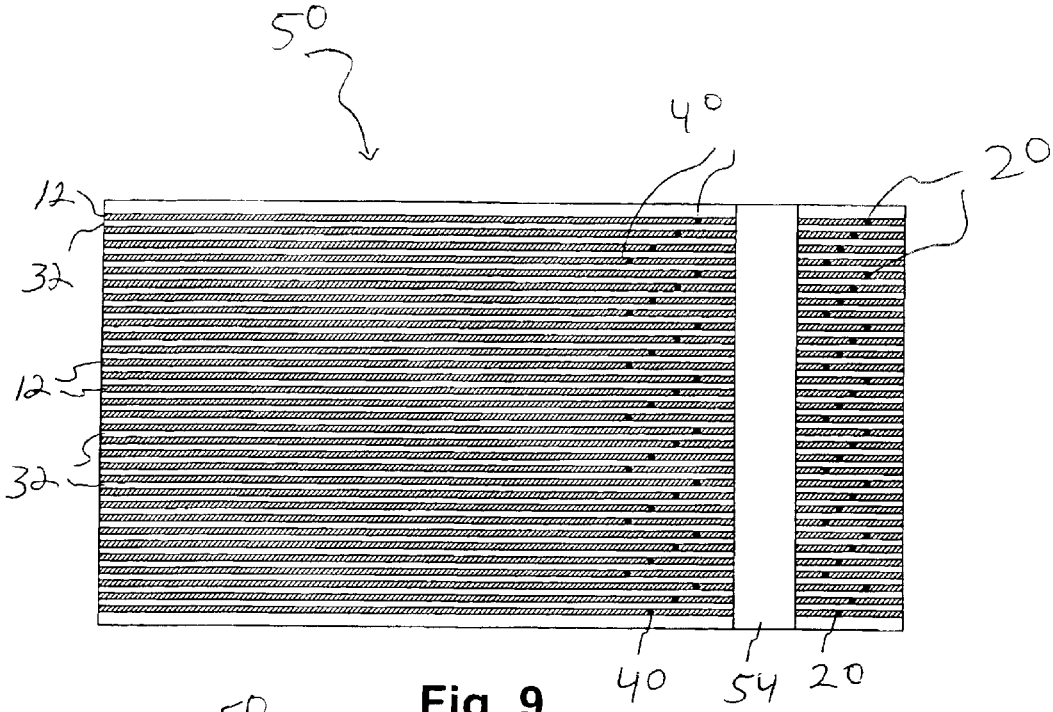
FIG. 9 illustrates another alternative embodiment wherein the slot applicator of FIG. 7 includes a channel across the plurality of slots.
Figure 10:
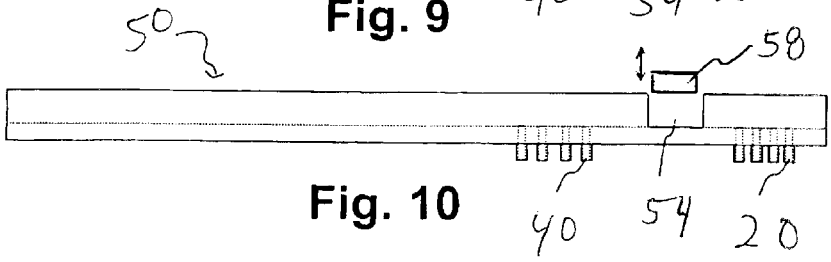
FIG. 10 illustrates a front view of the slot applicator of FIG. 9.

A slot applicator 50 of the present invention, as shown in FIGS. 9 and 10, is identical to the slot applicator 38 except for the inclusion of a channel 54. The channel 54 is oriented in a manner substantially perpendicular to the length L of the plurality of slots 12 of the slot applicator 50. The channel 54 communicates with each slot 12 by removing a portion of the dividers 32. Preferably, the channel 54 communicates with the slots 12 between the passageway 20 and the passageway 40 as shown in FIG. 9. The channel 54 is sized to receive a squeezing or doctoring member of a material such as a sponge 58 to be used to contact the advancing yarn in the slots 12 of the slot applicator 50. Other materials such as rubber, steel, glass rod, fabric and their equivalents, may be substituted for the sponge. The sponge 58 may be lowered into the channel 52 to contact the advancing yarn in the slots 12. By contacting the advancing yarns in the slots 12, improved distribution of a fluid such as the prewetting solution from the passageways 20 can be obtained. Pressure may be applied by the sponge 58 to increase the amount of contact between the advancing yarns and the sponge 58.

Figure 11:
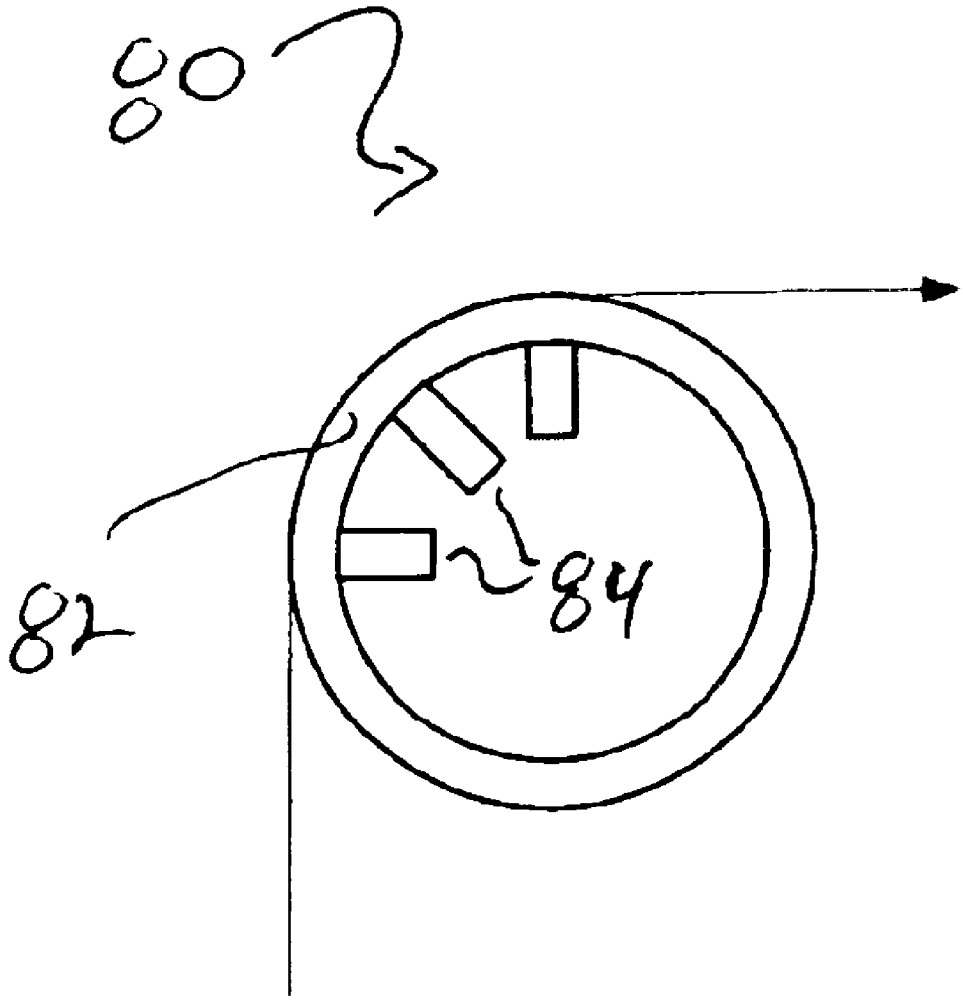
FIG. 11 illustrates a front view of an alternative embodiment of a circular slot applicator.

In the present invention, the slot 12 can be either planar or arcuate. For example, as shown in FIG. 11, a circular member 80 may be used to define an arcuate slot 82. A round slot applicator of approximately 4 inches in diameter would have an arcuate slot of approximately 3.14 inches. Fluid is metered into the slot 82 via passageways 84. With an arcuate slot, the tension in the yarn will hold the yarn in the bottom of the slot. The fluid is picked up by the yarn as it is pulled through the slot 82.

The use of the slot 12 as described above constitutes an inventive method of the present invention in addition to the slot 12 itself. In practicing the method of applying a metered fluid to an advancing yarn, the steps include providing the slot 12, as described above, having a length L defined by a predetermined residence time of the advancing yarn in the slot 12. The method of the present invention can include the step of varying the length L of the slot 12 to correspond with the speed of the advancing yarn to obtain the predetermined residence time. The method then includes metering the fluid into the slot 12. Then, the yarn is advanced in the slot 12 along the length L such that the advancing yarn resides in the slot 12 for the predetermined amount of time.

The method of the present invention can also include the steps of metering a second fluid into the slot 12 as well as contacting the advancing yarn in the slot 12 with a squeezing member such as a sponge 58 oriented in a manner substantially transverse to the advancing yarn.

The present invention has been illustrated in relation to particular embodiments which are intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. An apparatus for uniformly applying a fluid to an individual advancing yarn, said apparatus comprising a slot applicator having at least one slot for receiving the advancing yarn and for bringing the advancing yarn into contact with the fluid being metered into said slot, said slot having opposed sides and having a width, a height, and a length for affecting the distribution of the fluid onto the advancing yarn, said width being a distance between said opposed sides allowing for the passage of the advancing yarn between said opposed sides of said slot and to maintain the fluid retained between said opposed sides in contact with the advancing yarn passing therethrough, said length being greater than said width, said length beginning at the location of introduction of the fluid into said slot and extending to the end of said slot where the advancing yarn exits said slot applicator, and providing the advancing yarn a residence time in said slot defined by said length of said slot divided by the speed of the advancing yarn of at least about 0.03 seconds wherein the yarn advancing through said slot advances at a rate of at least approximately 100 yards per minute.

2. The apparatus of claim 1 wherein the yarn advancing through said slot advances at a rate of at least 1,000 yards per minute.

3. The apparatus of claim 1 wherein the advancing yarn has a residence time in said slot defined by said length of said slot divided by the speed of the advancing yarn of between approximately 0.03 seconds and 0.2 seconds.

4. The apparatus of claim 1 wherein the advancing yarn has a residence time in said slot defined by said length of said slot divided by the speed of the advancing yarn of approximately 0.08 seconds.

5. The apparatus of claim 1 having a ratio of said width of said slot to a diameter of the advancing yarn in the range of approximately 1.1 to 10.

6. The apparatus of claim 5 wherein said ratio is preferably approximately 1.2 to 5.0.

7. The apparatus of claim 1 wherein said length of said slot is at least approximately 24 inches and the advancing yarn has a residence time in said slot of approximately 0.08 seconds while advancing at approximately 500 yards per minute.

8. The apparatus of claim 1 further comprising a plurality of said slots separated from one another and a channel communicating with and substantially perpendicular to said length of said slots, said channel for receiving means for contacting the advancing yarn in said slots, whereby the distribution of the fluid in said advancing yarn is improved.

9. The apparatus of claim 8 wherein said contacting means is a sponge.

10. The apparatus of claim 8 wherein pressure is applied by said contacting means to squeeze the advancing yarn in said slot.

11. The apparatus of claim 1 wherein said slot is formed from a hollow annular member the opposed sides of which are arcuate.

12. The apparatus of claim 1 further comprising a first passage for metering a first fluid to said slot and a second passage for metering a second fluid to said slot, said first passage displaced from said second passage along said length of said slot.

13. The apparatus of claim 12 further comprising a channel communicating with and substantially perpendicular to said length of said slot, said channel for receiving means for contacting the advancing yarn in said slots, and said channel positioned between said first passage and said second passage.

14. The apparatus of claim 13 further including a contacting means for contacting the advancing yarn positioned in association with said channel between said first passage and said second passage.

15. The apparatus of claim 14 wherein said first passage serves to introduce a pre-wetting fluid, said contacting means serves to distribute the pre-wetting fluid on the advancing yarn and said second passage serves to introduce the fluid.

16. The apparatus of claim 12 wherein the distance between said first and said second passages of said slot is varied to adjust the uniform application of said first and second fluids to the advancing yarn.

17. The apparatus of claim 1 wherein said width is sufficiently large so as to not pinch the advancing yearn, but small enough so that the fluid is substantially continuously in contact with the advancing yarn between said sides in said slot.

18. The apparatus of claim 1 wherein said length is sufficient to prevent the fluid from flowing out of an exit end of the slot.

19. The apparatus of claim 1 wherein the opposed sides of said slot are substantially parallel.

20. An apparatus for uniformly applying a fluid to an individual advancing yarn, said apparatus comprising a slot applicator having at least one slot for receiving the advancing yarn and for bringing the advancing yarn into contact with the fluid being metered into said slot, said slot having opposed sides and having a width, a height, and a length for affecting the distribution of the fluid onto the advancing yarn, said width being a distance between said opposed sides allowing for the passage of the advancing yarn between said opposed sides of said slot and to maintain the fluid retained between said opposed sides in contact with the advancing yarn passing therethrough, said length being greater than said width, said length beginning at the location of introduction of the fluid into said slot and extending to the end of said slot where the advancing yarn exits said slot applicator, and providing the advancing yarn a residence time in said slot defined by said length of said slot divided by the speed of the advancing yarn of at least about 0.03 seconds, wherein said length of said slot ranges from approximately 2 inches to approximately 48 inches.

* * * * *